US005152086A

United States Patent [19]

Bonaventure

[11] Patent Number: 5,152,086

[45] Date of Patent: Oct. 6, 1992

[54] FOOT COMFORT ELEMENTS

[75] Inventor: Laurent Bonaventure, Cran Gevrier, France

[73] Assignee: Salomon S.A., Annecy Cedex, France

[21] Appl. No.: 641,728

[22] Filed: Jan. 15, 1991

[30] Foreign Application Priority Data

Jan. 26, 1990 [FR] France ..... 90 01098

[51] Int. Cl.[5] ..... A43B 5/04; A43B 19/00; A43B 17/00

[52] U.S. Cl. ..... 36/117; 36/71; 36/55; 36/10; 36/119

[58] Field of Search ..... 36/117, 88, 93, 119, 36/55, 71, 10

[56] References Cited

U.S. PATENT DOCUMENTS

| | | | |
|---|---|---|---|
| 2,238,804 | 4/1941 | Brown | 36/10 |
| 2,904,980 | 9/1959 | Stinson | 36/10 |
| 3,239,952 | 3/1966 | Lange et al. | 36/119 |
| 3,858,337 | 1/1975 | Vogel | 36/119 |
| 3,936,959 | 2/1976 | Hanson et al. | 36/119 |
| 4,078,322 | 3/1978 | Dalebout | 36/10 |
| 4,510,703 | 4/1985 | Eiteljorg | 36/119 |
| 4,523,392 | 6/1985 | Gabrielli | 36/10 |
| 4,910,889 | 3/1990 | Bonaventure et al. | 36/71 |

FOREIGN PATENT DOCUMENTS

| | | | |
|---|---|---|---|
| 0107841 | 5/1984 | European Pat. Off. | 36/119 |
| 1924306 | 2/1961 | Fed. Rep. of Germany | 36/10 |

*Primary Examiner*—Paul T. Sewell
*Assistant Examiner*—M. Denise Patterson
*Attorney, Agent, or Firm*—Sandler, Greenblum & Bernstein

[57] ABSTRACT

A removable protective cover for use with a liner of a sports shoe or boot, and a liner adapted for use with the cover. The cover includes a sock portion and a fold-back portion, the fold-back portion being movable over the front upper portion of the upper of the liner to provide a linkage between the protective cover and the liner. Corresponding, non-permanent attachment zones may be provided on the protective cover and the liner. The sock portion may include an extension, preferably composed of an elastic waterproof material, which may partially or completely cover the exterior surface of the liner.

12 Claims, 4 Drawing Sheets

Fig- 6
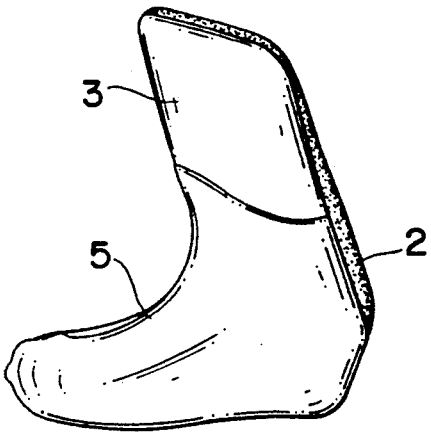
Fig- 7
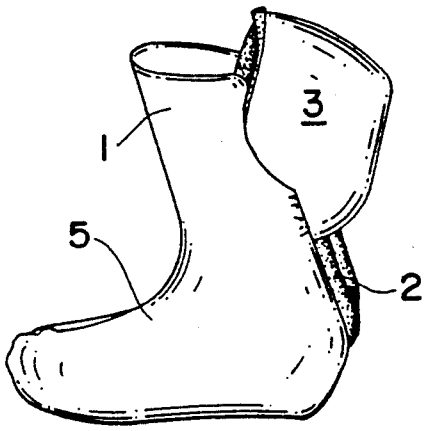
Fig- 8
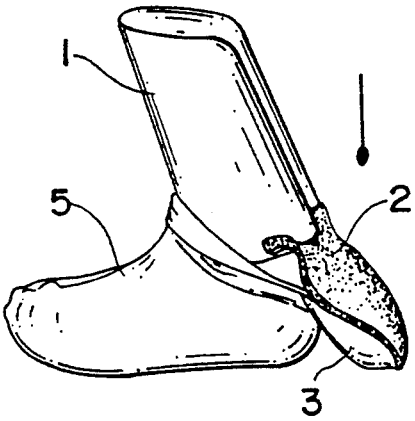
Fig- 9
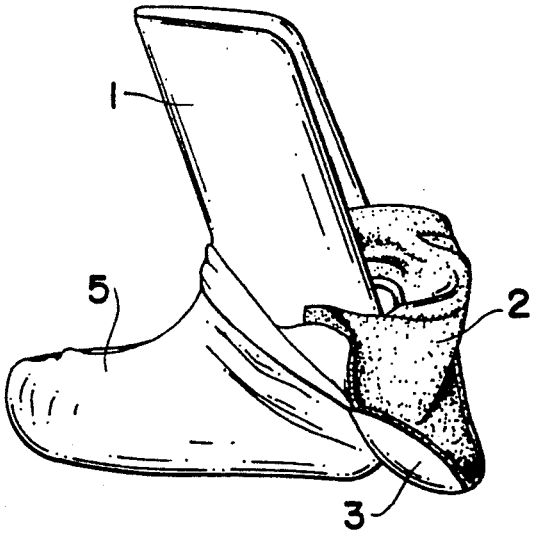
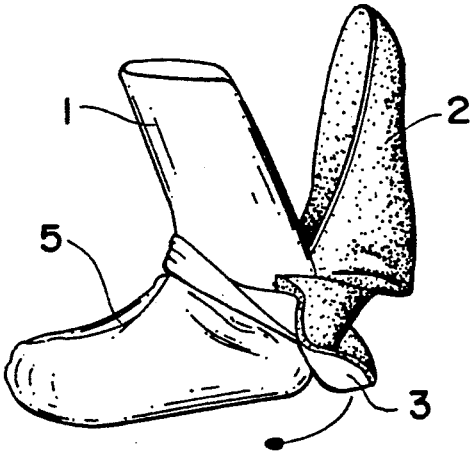
Fig- 10

FOOT COMFORT ELEMENTS

BACKGROUND OF THE INVENTION

1. Field of the Invention

The present invention relates to elements which comfort, protect, and maintain the foot of the wearer within articles of athletic footwear, including sports shoes and boots, for example, ski boots or mountain boots, and especially those which have a rigid shell.

More particularly, the present invention is directed to a removable protective element for covering, at least partially, a liner for an athletic shoe or boot, and to a liner adapted to receive the removable protective element.

2. Description of Background and Relevant Information

There are many types of athletic footwear, such as ski boots and ice skates, where it is necessary as a matter of function to securely maintain the foot in a desired position within a shoe or boot. This is necessary because excessive movement of the foot independent of movement of the article of footwear can significantly detract from the responsiveness of the footwear, impairing the wearer's ability to perform skillfully and even posing a possible health hazard. Examples of elements used to accomplish this include internal liners, rear wedges, front tongues, and other accessories.

At the same time, it is necessary to provide a comfortable environment for the foot, both to avoid compromising the wearer's ability to enjoy the sport in question, and to prevent surface trauma to the foot such as blisters and subsurface trauma such as cramping and sprains.

As may be seen, the function of maintaining the foot securely in place in the boot or shoe is distinct from the function of providing comfort and protection to the foot. This distinction is reflected in differences in the materials appropriate to each; in order to maintain the foot in place, a relatively firm or semi-rigid structure is most appropriate, whereas comfort and protection are better served by a relatively soft or resilient structure.

The elements currently used in athletic footwear to accomplish these ends accordingly consist of two main portions. The first portion is composed of a relatively rigid, dense material that conserves its functional shape, serving primarily to hold the foot in a given position within the shoe or boot. In the case of an internal liner, this material takes the shape of a sock-shaped envelope designed to hold the foot. The second portion is composed of relatively soft paddings or coverings that aim to avoid, at least at critical locations, excessive contact pressures between the foot and the liner and/or the outer shell of the shoe or boot.

The need to combine these two portions in a single element, in order to obtain both secure placement and comfort of the foot, is reflected in the form of superpositions. The base for these superpositions is a relatively rigid envelope having a cavity that conforms closely to the shape of the foot and which is sufficiently dense to ensures mechanical retention of the foot in a given position. Over this envelope is superimposed a covering made out of a material which is softer and more resilient, to ensure the comfort of the foot.

The assembly of this covering to the envelope is normally done in a permanent manner, as by gluing or stitching. This poses compatibility problems between the various materials utilized, and those problems are complicated by the desire to fulfill overall design goals such as reducing the cost of manufacture, utilizing specific materials, and minimizing the complexity of assembly.

Furthermore, the elements used to comfort, protect, and maintain the foot are subject to wear. In particular, the soft coverings, and especially those portions positioned adjacent the top of the upper of the shoe or boot, are subject to wear and soiling due to repeated putting on and taking off of the boot.

It has been attempted, in the context of a rear wedge, to protect the soft covering at these critical locations using a skin which is both flexible and resistant to the above cited attacks. This attempt involved providing, for attachment on the vulnerable areas of the semi-rigid portion of the liner, a protective cover composed of a soft covering for comfort, and a protective skin capable of folding down on itself, at least partially, through elastic deformation, around the semi-rigid portion. However, this protective cover still remains permanently attached to the semi-rigid portion of the liner by traditional means such as sewing or gluing over substantial lengths or surfaces. This remedy to the disadvantages cited above only delays degradation due to wear because it is the fixed protective cover which will undergo these degradations, a protective cover which can only be replaced by replacing the liner in its entirety.

SUMMARY OF THE INVENTION

The above disadvantages are overcome by means of the present invention, which provides a comfort protective cover for a semi-rigid maintenance element of the foot in a boot, particularly a boot of the rigid shell type. The protective cover is removable, and includes portions provided with paddings for the sensitive zones of the foot of the wearer. The protective cover also includes at least one fold-back which is removably connectable, such as by a flexible reverse side, to the semi-rigid maintenance element.

The protective cover may further comprise non-permanent connection means cooperating with corresponding means carried by the semi-rigid element. These means may be, for example, of the hook-and-loop or pressure button type.

In a preferred embodiment, the semi-rigid maintenance element has the shape of a rear entry-type liner, and the protective cover correspondingly has the form of a sock sheltered in the liner, and is connected on the exterior to the upper of the liner by means of a fold-back. The protective cover may further comprise an extension, which is connected at least under the heel of the liner, and which may entirely cover the exterior surface of the liner.

In alternative embodiments, the protective cover of the present invention may be adapted to at least partially cover a rear wedge for the foot of the wearer, or a front tongue of a front entry boot.

The present invention extends to a semi-rigid maintenance element for use with the comfort protective cover as described above. The semi-rigid element may include non-permanent connection means, such as the hook-and-loop type or the pressure button type, cooperating with corresponding means carried by the comfort protective cover.

In an alternative embodiment, the present invention is directed to a removable protective cover for use with a liner of a sports shoe or boot. The protective cover includes a sock portion and a fold-back portion, with the fold-back portion being movable over the front upper portion of the upper of the liner to provide a linkage between the protective cover and the liner, particularly the upper of the liner; in this way, the protective cover may be easily separated from the liner.

The removable protective cover may include non-permanent means for connecting the protective cover to the liner. The non-permanent connecting means, such as a hook-and-loop closure or a pressure button closure, are adapted and configured to cooperate with corresponding means carried on the liner.

Preferably, the sock portion of the protective cover comprises an internal envelope which may be inserted within the liner, and includes paddings to provide comfort for the sensitive zones of a foot of a wearer. In a particularly preferred embodiment, the sock portion and the internal envelope are adapted and configured for use with a liner which is open towards the rear, such as liner for a rear-entry ski boot.

The removable protective cover may further comprise an extension connected to the fold-back portion and adapted and configured to extend under the heel of the liner when the protective cover is assembled to the liner. The extension, which is preferably composed of elastic and/or waterproof material, may cover the entire exterior surface of the liner, and is removable from the liner through eversion.

The protective cover may include indicators, positioned on the protective cover so as to demarcate the exterior contact zone with the exterior side of the sole of the liner. These indicators will facilitate assembly of the protective cover to the liner.

In a yet further embodiment, the present invention is directed to a removable protective element for use with a sports shoe liner, where the liner has a lower portion extending generally horizontally along the foot and a upper portion extending generally vertically from the lower portion in the direction of the lower leg. The protective element includes a sock portion, a cuff portion, and means for removably connecting the protective element to the liner, such as a hook-and-loop or pressure button type closure. The connecting means may be adapted and configured to cooperate with corresponding means on the liner, and may comprise providing the cuff portion with a fold-back element adapted to fit over at least the front cuff of the upper portion. The fold-back element should be composed of a relatively elastic material, such that the fold-back element may be disconnected from the front cuff by eversion.

The sock portion of the protective cover may include an internal envelope, which may be inserted within the liner when the protective element is assembled to the liner. This internal envelope may comprise paddings for the foot of a wearer.

BRIEF DESCRIPTION OF DRAWINGS

The characteristics of the invention and other advantages of the invention will become apparent by reviewing the description which follows with reference to the annexed drawings, illustrating non-limiting embodiments given by way of example only, in which:

FIG. 6 is a left side view of another embodiment of the present invention, in which sock portion 2 includes extension 5 covering the entire exterior surface of the liner.

FIG. 7 shows the initial removal of the protective cover shown in FIG. 6, in which cuff portion 3 has been detached from the front upper region of liner 1 through eversion.

FIG. 8 shows a continuation of the removal process started in FIG. 7; cuff portion 3 has been drawn down to the heel region of liner 1, along the direction of the arrow, providing access to that part of sock portion 2 which is inserted within liner 1, with resulting elastic deformation of extension 5.

FIG. 9 shows a partial extraction of that part of sock portion 2 which is inserted within liner 1.

FIG. 10 shows the entirety of sock portion 2 having been extracted from the interior of liner 1; sock portion 2 and cuff portion 3 may now be drawn in the clockwise direction shown by the arrow in order to remove extension 5 from the liner.

DESCRIPTION OF PREFERRED EMBODIMENTS

Figure 1:
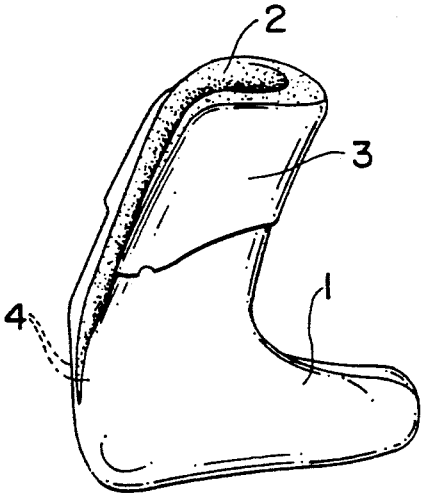
FIG. 1 provides a right side view of an embodiment of the present invention, including sock portion 2 and fold-back 3, with the position of interior lateral connection zones 4 indicated by dotted lines.

The present invention has the objective of overcoming the disadvantages and insufficiencies discussed above by providing, for elements which comfort, protect, and maintain the foot of a wearer within articles of athletic footwear, a readily removable protective cover. By virtue of being removable, such a protective cover can be easily separated from the semi-rigid portion of the element being considered, so as to be, for example, washed, repaired, or simply replaced, without the comfort/protection/maintenance element itself having to be discarded and replaced in its entirety.

The elimination of stitching or gluing made possible by the present invention will make possible a greater choice of materials, particularly in the case of rear wedges or front tongues. Examples of such materials include, for example, polyurethanes that are different from those presently utilized, including ones that are lighter and more rigid for the semi-rigid portion of the maintenance elements. It will no longer be necessary, in selecting these materials, to be constrained by how receptive the materials will be to stitching and/or gluing.

Furthermore, the elimination of stitching or gluing will translate into substantial savings of time during assembly of the protective cover on a semi-rigid support. It will also make possible a case-by-case choice of protective covers depending upon factors such as thickness, the specific type of comfort desired, and coloration.

It should further be noted that the separation between the maintenance element and the comfort protective cover makes it possible to store these elements separately, which gives greater flexibility in the choice of these elements for their assembly.

In the case of ski boots, this will provide the further advantage of greatly simplifying the otherwise difficult task of keeping the interior of the boot dry. At present, this must be done by leaving the boot open and unused for a substantial amount of time; by removing the entire liner, allowing it to dry, and re-inserting it; or by purchasing expensive drying aids, generally in the form of heated inserts which are placed inside the liner to accelerate drying. Because the liner is generally quite dense, moisture does not readily evaporate from the interior through its surface; the physical configuration of such liners results in a relatively large ratio of the interior surface area to the cross-section of the air passageway leading to the liner interior, such that evaporation from the interior through the air passageway occurs slowly; and the liners are generally made of materials which would be deformed by rigorous heated air drying, such as by being placed in a clothes dryer.

In the present invention, the majority of any moisture buildup will be retained in the sock portion of the protective cover. This may be readily extracted from the liner for drying. The ability to select from a range of materials for the sock portion will permit use of a material which allows moisture from the interior of the sock to simply wick through the sock material to the surface, where it can easily evaporate; or, the sock may even be composed of a material which will allow it to be placed in a clothes dryer, either for heated air drying or simply for forced air drying at ambient temperatures.

Figure 13:
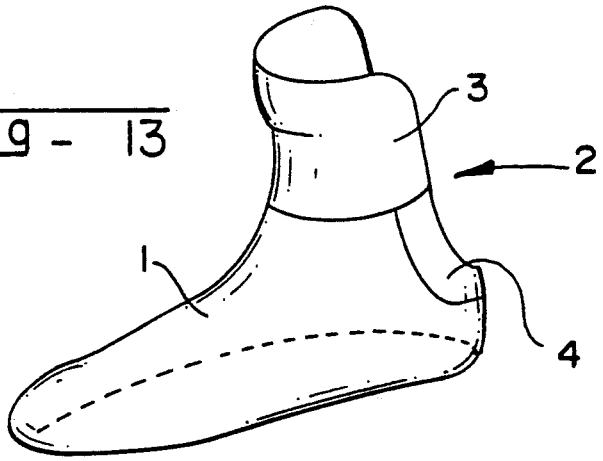
FIG. 13 illustrates an embodiment of the invention for a comfort and maintenance liner for a rear entry ski boot, corresponding to that shown in FIG. 1, including liner 1, sock portion 2, cuff portion 3, and attachment zone 4.

FIGS. 1 and 13 illustrate a non-limiting example of a conventional ski liner 1, which is open towards the rear for a rear entry boot. This liner 1, made of a semi-rigid material, assures, amongst other things, the secure maintenance of the foot in the rigid shell of the boot.

The comfort of the foot is assured by an internal envelope or sock 2, having appropriate paddings for the foot of the wearer, which is inserted within the liner, or semi-rigid maintenance element 1. It is this sock 2 which, with semi-rigid liner 1, assures the maintenance and the comfort of the foot in the rigid shell of the boot.

According to the present invention, sock 2, which comprises in a known manner comfort paddings for the sensitive zones of the foot of the wearer, is in no way affixed to the semi-rigid liner 1. Rather, sock 2 has, at its upper portion, i.e., relative to the upper of the liner 1, a fold-back 3, made for example of a relatively elastic material. Fold-back 3 moves, in the form of a true protective cover, over the front upper portion of the upper of the liner 1, in the manner of a reverse side of a garment, such as for example, the reverse side of a cuff or a sock folded back on the upper edge of the collar of the upper of a boot. The fold-back is disassociated from the front upper portion of the upper of the liner by being turned inside out, i.e., through eversion.

This fold-back 3 may not be able to ensure a sufficiently effective linkage between the protective cover and its semi-rigid support. In such a case, it is convenient to provide both the protective cover, as well as its semi-rigid support, with non-permanent connection means, always allowing for removability of the protective cover from its support. These means, identified by the number 4 in FIG. 1, can be of any appropriate type, particularly of the hook-and-loop type (sometimes designated under the denomination "VELCRO®") or of the pressure button or snap-button type, or others, and can be positioned on the one side on the protective cover and on the other on the support, i.e., liner. A portion to be folded back on the support, such as fold-back 3 described above, can be provided for this purpose, as illustrated in FIG. 1.

Figure 14:
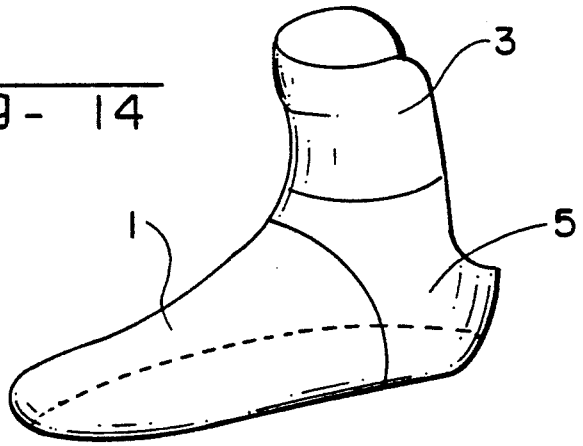
FIG. 14 shows another embodiment of a protective cover according to the invention, also adapted for a ski boot liner; in this embodiment a partial extension 5 extends under the heel region of the liner.

Alternatively, and as illustrated schematically in FIG. 14, this removable connection or linkage function of the protective cover or sock 2 on liner 1 can preferably be economically assured by an extension connected by any appropriate means to fold-back 3. The extension is connected, essentially by virtue of the elastic properties of the material from which it is constructed, along the edges of the rear opening of the liner 1, and particularly under the heel of the liner 1.

Figure 15:
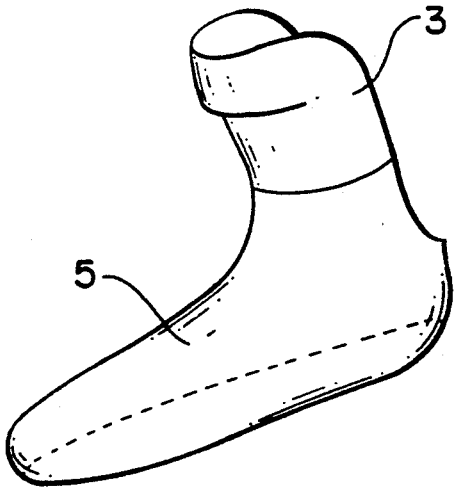
FIG. 15 illustrates a third embodiment, also for a ski boot liner, in which extension 5 covers the entire exterior surface of the liner.

This extension of sock 2, as has just been described, can assume the more elaborate form of an integral cover, and serve as a protective cover for the entire liner 1, as shown in FIG. 6 and 15, completely covering the external side of the liner. In this embodiment, the integral protective cover must be made out of a sufficiently stretchable material; will be waterproof/sealed. The linkages necessary for the construction of this sock will be similarly welded, preferably with the use of stitches. To facilitate assembly of the protective cover to the liner, indicators can be positioned on the protective cover, especially to demarcate the positioning of the exterior contact zone with the exterior side of the sole of the liner.

Further illustration of the protective cover according to the present invention is provided in the Figures. In general, FIGS. 1–3 and 5 depict a partial protective cover, that is, one which does not encompass the entire exterior surface of the liner, while FIGS. 6–12 show an integral protective liner which includes an extension 5 encompassing the outer surface of the liner.

Figure 2:
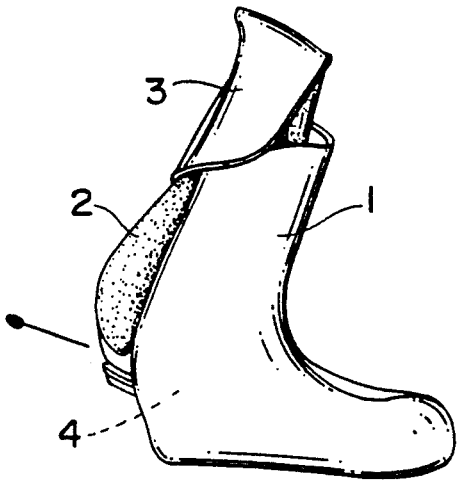
FIG. 2 shows the embodiment of FIG. 1, wherein fold-back 3 has been detached from the front upper region of liner 1 through eversion, and sock portion 2 has been partially withdrawn from the cavity of the liner in the direction of the arrow.
Figure 3:
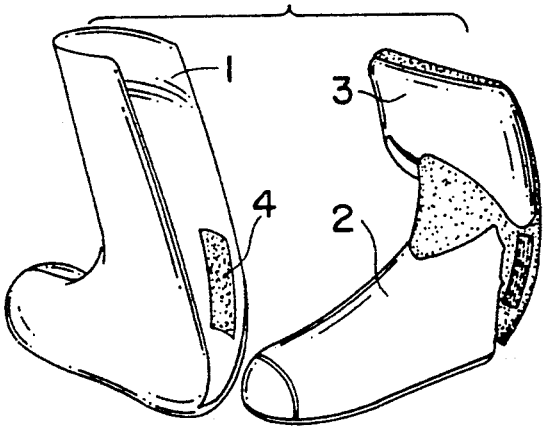
FIG. 3 shows the removable protective cover of the present invention fully removed from the liner 1. Attachment zone 4, corresponding to connection means on the protective cover, may be provided on the liner to improve the fixation of the cover to the liner, and may be Velcro ® as shown or any other suitable non-permanent connecting means, such as a pressure button.
Figure 4:
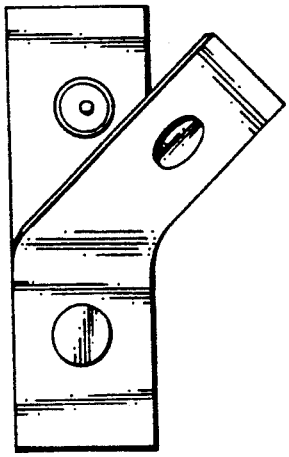
FIG. 4 shows a connecting means in the form of a pressure button, which may be correspondingly positioned on the protective cover and the liner such that with the protective cover fully inserted in the liner the two portions of the pressure button may be snapped together.
Figure 5:
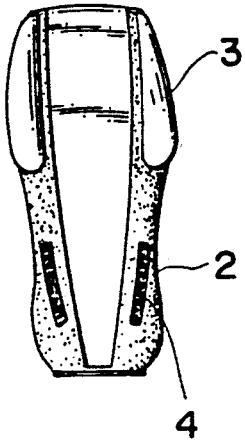
FIG. 5 is a rear view of the protective cover according to the present invention, showing laterally positioned attachment zone 4.
Figure 11:
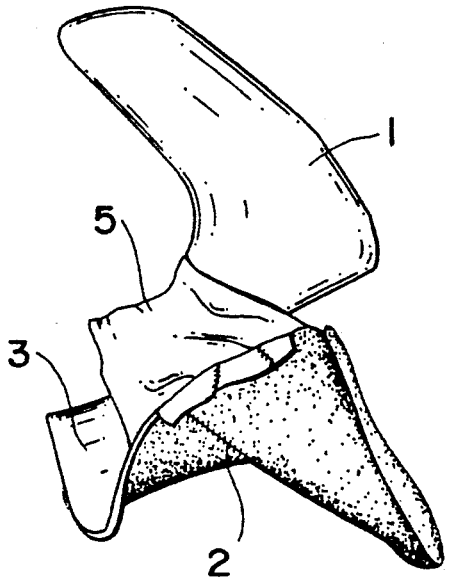
FIG. 11 shows the removal of extension 5 from liner 1, at approximately a mid-way point.
Figure 12:
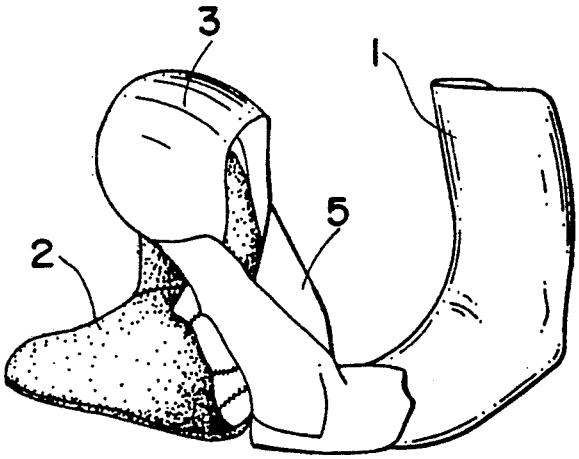
FIG. 12 shows the protective element fully detached from liner 1; for reassembly to the liner, the steps shown in FIGS. 7–11 would be carried out in reverse order, starting with the stretching of extension 5 from the toe region of the liner back towards the instep.

As may be seen, the partial protective cover of the present invention, as illustrated, for example, in FIGS. 1–3, provides a readily detachable comfort element, in the form of sock portion 2 and cuff element 3, which can be dried, cleaned, and replaced independently of liner 1. Moreover, by placing cuff portion 3 on the protective cover, that portion of a conventional ski boot liner which is most susceptible to wear and soiling has been separated from the body of the liner itself, and may thus be dealt with as appropriate to its condition without requiring treatment of the entire liner. This also makes it possible to provide, for a given shoe or boot, a selection of protective covers in which parameters such as thickness, the specific type of comfort desired, and coloration may be varied to suit the wearer.

By further providing extension 5, as shown, for example, in FIGS. 6–12 and 14–15, to the above advantages may be added that of rendering the liner waterproof. Water leakage through the numerous joins, fittings, and apertures present in the rigid outer shell of a ski boot can substantially detract from the wearer's ability to enjoy skiing, and may induce muscle spasms or cramps. By providing the protective cover according to the present invention with a waterproof extension, such leaks can be prevented from reaching the foot of the wearer. In addition to thus protecting the foot of the wearer, the waterproof extension will prevent the liner and sock from absorbing such leakage, substantially reducing the amount of time needed to dry the boot after use.

What has just been said with reference to a protective cover in the form of a sock which is mounted in and on a liner is, of course, likewise valid, has the advantage of simplicity, and does not extend beyond the scope of the invention, for other maintenance and comfort accessories of the foot, such as rear wedges or front tongues for front entry boots.

The present invention has of necessity been discussed herein by reference to certain specific methods, materials, and configurations. It is to be understood that the discussion of these specific methods, materials, and configurations in no way constitutes any limitation on the scope of the present invention, which extends to any and all alternative methods, materials, and configurations suitable for accomplishing the ends of the present invention.

What is claimed is:

1. A comfort protective cover for a maintenance element of the foot for use in a rigid shell boot, said maintenance element being less rigid than the rigid shell of the rigid shell boot, said protective cover being removable and comprising portions provided with paddings for predetermined zones of the foot of the wearer and further comprising at least one fold-back removably connectable, by a flexible reverse side, to the maintenance element, wherein the maintenance element has the shape of a liner of the rear entry type, and wherein said protective cover has the form of a sock sheltered in the liner and is connected on the exterior to the upper of the liner by means of a fold-back, further comprising an extension which is connected under the heel of the liner.

2. A comfort protective cover for a maintenance element of the foot for use in a rigid shell boot, said maintenance element being less rigid than the rigid shell of the rigid shell boot, said protective cover being removable and comprising portions provided with paddings for predetermined zones of the foot of the wearer and further comprising at least one fold-back removably connectable, by a flexible reverse side, to the maintenance element, wherein the maintenance element has the shape of a liner of the rear entry type, and wherein said protective cover has the form of a sock sheltered in the liner and is connectable on the exterior to the upper of the liner by means of a fold-back, further comprising an extension which entirely covers the exterior surface of the liner.

3. A removable protective cover for use with a liner of a sports shoe or boot, said liner having a front upper portion, said protective cover comprising a sock portion and a fold-back portion, said fold-back portion being movable over the front upper portion of the upper of the liner to provide a linkage between said protective cover and the liner for facilitating removal of said protective cover from the liner, further comprising an extension connected to said fold-back portion and adapted and configured to extend under the heel of the liner.

4. The removable protective cover as defined by claim 3, wherein said extension is composed of elastic material.

5. The removable protective cover as defined by claim 4, wherein said extension is adapted and configured to cover the entire exterior surface of the liner.

6. The removable protective cover as defined by claim 5, wherein said extension is waterproof.

7. The removable protective cover as defined by claim 5, further comprising indicators positioned on said protective cover so as to demarcate the exterior contact zone with the exterior side of the sole of the liner, thereby facilitating assembly of said protective cover to the liner.

8. The removable protective element for use with a sports shoe liner having a lower portion extending generally horizontally along the foot and an upper portion extending generally vertically from the lower portion in the direction of the lower leg, said protective element comprising a sock portion, a cuff portion, and means for removably connecting said protective element to the liner, further comprising an extension connected to said cuff portion, said extension being adapted and configured to extend under the heel of the liner when said protective element is assembled in the liner.

9. The removable protective cover as defined by claim 8, wherein said extension is composed of elastic material.

10. The removable protective cover as defined by claim 8, wherein said extension is adapted and configured to cover the entire exterior surface of the liner, further wherein said extension may be removed from the exterior surface of the liner by eversion.

11. The removable protective cover as defined by claim 10, wherein said extension is waterproof.

12. The removable protective cover as defined by claim 10, further comprising indicators positioned on said protective cover so as to demarcate the exterior contact zone with the exterior side of the sole of the liner, thereby facilitating assembly of said protective cover to the liner.

* * * * *